United States Patent [19]

Saint-Remy Pellissier

[11] 3,958,646

[45] May 25, 1976

[54] PENETROMETER FRAMES

[75] Inventor: Charles Marc Marie Saint-Remy Pellissier, Avignon, France

[73] Assignee: Societe Anonyme Fondasol-Technique, Avignon, France

[22] Filed: Jan. 24, 1975

[21] Appl. No.: 543,953

[30] Foreign Application Priority Data

Jan. 29, 1974 France ..... 74.03871

[52] U.S. Cl. ..... 173/44; 73/84; 173/28; 173/46; 173/131; 173/152

[51] Int. Cl.[2] ..... G01N 3/42; G01N 3/00

[58] Field of Search ..... 73/84, 22, 12; 173/20, 173/21, 28, 43, 44, 46, 39, 124, 53–56

[56] References Cited

UNITED STATES PATENTS

| | | | |
|---|---|---|---|
| 2,593,186 | 4/1952 | Richardson | 173/53 |
| 3,708,024 | 1/1973 | Back | 173/28 X |
| 3,780,816 | 12/1973 | Arrington et al. | 173/39 X |

FOREIGN PATENTS OR APPLICATIONS

| | | | |
|---|---|---|---|
| 1,553,707 | 12/1968 | France | 73/85 |

*Primary Examiner*—Ernest R. Purser
*Attorney, Agent, or Firm*—Karl F. Ross; Herbert Dubno

[57] ABSTRACT

A penetrometer frame for mounting on, for example, a truck and comprising a fixed part provided with slides which guide a moving part in the form of a frame which itself serves as a guide for a driving hammer and which may be raised or lowered by two hydraulic rams. The fixed part of the frame is pivoted on a platform about a horizontal pivot offset from the point where tubes are inserted or removed. The arrangement is such that extending the rams causes the penetrometer frame to pivot and allows access to the position at which tubes are inserted or removed.

7 Claims, 5 Drawing Figures

PENETROMETER FRAMES

The present invention relates to a penetrometer frame.

The penetrometer is a means for exploring the ground to drive a probe placed at the lower end of a set of tubes, into the ground. The measurements which may be undertaken by means of the penetrometer are mainly, displacement of the probe, the resistance exerted on its point and the resistance exerted on its lateral surface as well as the resistance exerted on the entire set of tubes.

The measurements mainly take place during "static" operation of the apparatus, which consists of exerting considerable pressure on the top of the set of tubes, by means of powerful hydraulic means. When it is desired to make borings, in very hard ground, the penetration of the probe is achieved by means of a driving hammer. This operation is qualified as "dynamic" and, when it is in progress, it is necessary to forgo taking most of the measurements. Further measurements are also made when the probe is removed from the ground, in order to determine the resistance to this extraction.

Penetrometers operating according to the above-mentioned principles have a frame generally mounted on a truck capable of travelling over any ground. In known manner, this frame may comprise a fixed part provided with vertical slides serving as guides for a movable part in the form of a frame, which may be lowered or raised by means of two large hydraulic rams. Located at the center of this moving part is the driving hammer driven by a mechanism comprising adhesion rollers in particular, with a longitudinal recess provided on each side of the hammer. These rollers may carry out a continuous rotary movement, during which they raise the hammer then allow it to drop as soon as the recessed parts appear. During static operation or extraction, the hammer is immobilized with respect to the moving part and it is this moving part which is actuated by means of the two aforesaid rams for driving in or raising the set of tubes.

A measuring head is interposed between an anvil disposed under the hammer and the top of the set of tubes, to undertake the recording during static operation or extraction. For dynamic operation, this measuring head must be removed. This operation is at present carried out manually and it has to be carried out many times during drilling, since static operation and dynamic operation are alternated. This results in a considerable waste of time and increases the duration of the measurements.

Other existing penetrometers currently exist have a frame composed of a fixed part and a moving part, in which this frame may be withdrawn in order to expose the central part where the set of tubes is located, in order to provide the space necessary for adding or removing tubes. A device of this type is described in particular in the Swiss Pat. No. 465.512 in the name of Raymond ANDINA and in the corresponding French Pat. No. 1.553.707. It comprises connecting rods pivoted to the frame and to fixed points in order to form deformable parallelograms which facilitate the withdrawal of the frame when the rams which move the movable part of this frame, reach the end of their upwards travel. The frame thus retracts, while remaining vertical, the arrangement being both withdrawn and raised.

This known device is relatively complex, owing to its large number of pivot points and it also has other drawbacks:

Owing to its pivoted structure, it lacks rigidity and mechanical strength, in particular when the connecting-rods are long, which is necessary to achieve considerable withdrawal.

Consequently, it is scarcely adaptable to large penetrometers, whereof the frame with the hammer represents a considerable weight.

In addition, as it is designed, this known device scarcely facilitates assembly and dismantling of the mesuring head, these operations always having to be undertaken manually.

It is the object of the present invention to remedy these drawbacks. To achieve this, the invention provides a penetrometer frame of the type comprising a fixed part provided with slides serving as guides for a moving part in the form of a frame, which itself serves as a guide for the driving hammer driven by a mechanism comprising adhesion rollers and which may be lowered or raised by means of two large hydraulic rams also making it possible, at the end of the upwards travel, to retract the frame arrangement rearwards in order to free the space above the set of tubes, with a simple mechanism which is rigid and solid, ensuring this retraction and also facilitating automatic handling of the measuring head.

According to the invention, this penetrometer frame comprises a fixed part directly pivoted to the platform about a horizontal pivot point offset with respect to the point where the set of tubes is located, in order to allow pivoting of the frame arrangement about this horizontal pivot under the action of the aforesaid rams.

The retraction of the frame takes place by simple tilting. The hammer and anvil thus move away by a sufficient distance from the region in which the set of tubes is located, which makes it possible to expose this region for adding or withdrawing tubes, without the apparatus having to have too great a height, thus preventing the risk of being cumbersome during movement of the truck.

In a particular embodiment, each slide belonging to the fixed part of the frame is integral with an arm extending rearwards and pivoted, at its front end, on the platform. The arrangement formed by a fixed slide and the arm which is integral therewith, constitutes a triangular structure, with the base normally resting on the platform but moving away therefrom, by pivoting, when the frame swings.

According to an extremely advantageous embodiment of the invention, between the two arms integral with slides belonging to the fixed part of the frame, the platform comprises a support, capable of receiving the measuring head when it is not in use, this support being disposed so as to be located on the trajectory of the head when, with the frame retained in the tilted position, said head is lowered by lowering the moving part of the frame by means of its two control rams.

With this device, one takes advantage of the tilting of the frame to automatically bring the measuring head into its storage position, when it is not in use and for retrieving this head when it once more becomes necessary.

The operation of picking-up or depositing the measuring head may thus take place very quickly, without any manual work and without it being necessary to dismantle the anvil. In the storage position, on its support, the measuring head is retained by a centering head and by a lug preventing its rotation.

According to another feature of the invention, the connection of the measuring head to the moving part of the frame is brought about by means of two lateral pivots, whereof each is able to connect one side of the measuring head to one of the slides of the aforesaid moving part. Centering of the measuring head takes place by means of a guide and centering head, provided at its upper part and able to co-operate with a complementary recess provided under the anvil. With the two afore-mentioned pivots, this guide and centering head makes it possible to position the measuring head very easily on the moving part of the frame.

The invention will be better understood by means of the ensuing description, referring to the accompanying diagrammatic drawing illustrating an embodiment of this penetrometer frame.

Figure 1:
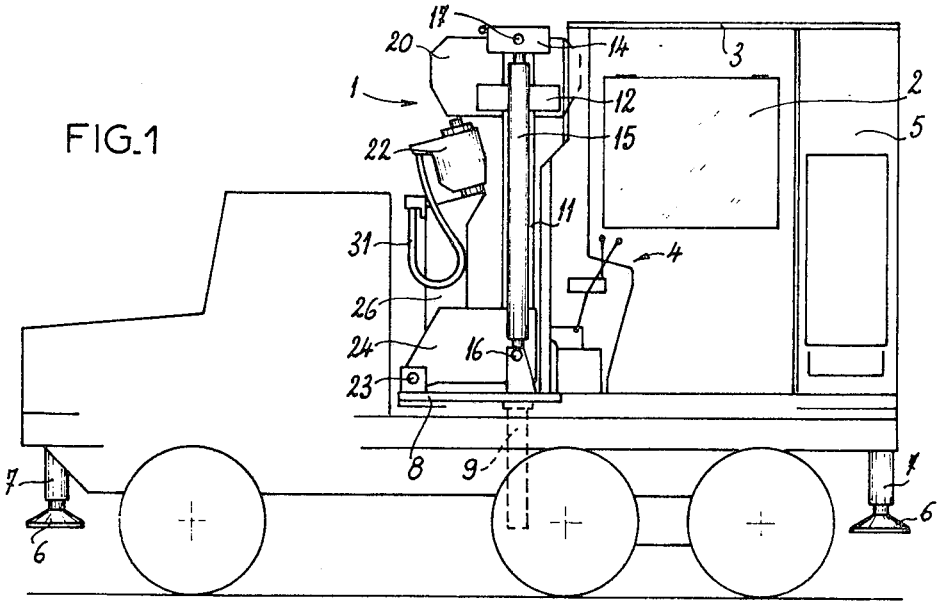
FIG. 1 is a general side view showing the frame on its truck.
Figure 3:
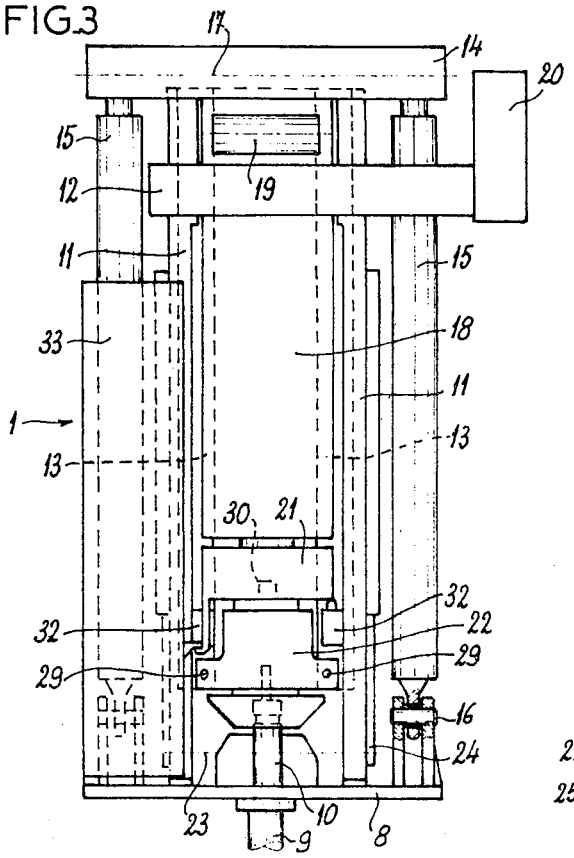
FIG. 3 is a front view of the frame, corresponding to FIG. 2.

FIG. 1 shows a truck capable of travelling on the ground, on which is mounted the frame 1 of the penetrometer according to the invention. This frame is placed at the center of gravity of the vehicle, just at the rear of the cabin. Provided behind the frame 1 is a cockpit 2 covered by a removable cover 3, intended for the operator. This cockpit also comprises the control console 4. A rear compartment 5 contains a thermal motor supplying a hydraulic unit. At both its ends, the support vehicle is equipped with stabilizers 6 which may be acutated by rams 7 controlled from the console 4.

The frame 1 is located above a platform 8, along the axis of which is mounted a vertical guide 9, through which the tubes 10 to be driven into the ground are introduced. In known manner, this frame 1 is composed of a so-called "fixed" part and a so-called "movable" part. The fixed part mainly comprises two symmetrical slides 11, which are normally vertical, connected at their upper end by a horizontal member 12, a so-called "fixed bar." The moving part, in the form of a frame, comprises two slides 13 engaged in the slides 11 of the fixed part. At their upper end, the slides 13 are connected by a horizontal member 14, a so-called "moving bar."

Two large rams 15 make it possible to lower or raise the moving part of the frame 1. At their base, these rams are pivoted on the platform 8 about horizontal pivots 16, located in the same vertical plane as the tubes 10. At their upper part, the rams 15 are pivoted, about a pivot 17, to the moving bar 14.

In known manner, the slides 13 of the movable part of the frame serve to guide a solid metal part 18 constituting a driving hammer. The alternating movements of the hammer 18 are obtained by means of a pair of adhesion rollers 19 located above the fixed bar 12. These rollers are pressed firmly against the hammer 18 and may be driven, by a mechanism located at 20, in a continuous rotary movement, during which they raise the hammer. Each roller 19 comprises a longitudinal recess and, when this recess is opposite the hammer, the latter is released and drops. The tubes 10 may thus be driven into the ground, according to a first operating possibility of so-called "dynamic driving".

In reality, the hammer does not act directly on the top of the tubes 10, but through the intermediary of an anvil 21 slidably mounted in the slides 13 of the moving part of the frame. Furthermore, at the time of static driving or extraction attempts, a measuring head 22 is interposed between the anvil 20 and the top of the tubes 10. According to the invention, the "fixed" part of the frame 1 is in fact pivoted to the platform 8, about a horizontal pivot 23, offset towards the front with respect to the vertical plane containing the tubes 10 and slides 11 and 13. In the embodiment illustrated in the drawing, each slide 11 belonging to the fixed part of the frame is integral with an arm 24 extending in a longitudinal vertical plane. The front end of each arm 24 pivots about the pivot 23 retained in bearings 25 integral with the platform 8. Thus, seen from the side, the arrangement of the frame 1 has the shape of a right-angled triangle, pivoted to the platform 8 at one of its acute angles.

Between the two afore-described arms 24, the platform 8 carries a support 26 able to receive the measuring head 22 when it is not used. At its top, this support comprises a centering head 27 and a lug 28 for preventing rotation, intended to keep the measuring head 22 in its stored position.

Naturally, in its lower part, the measuring head 22 comprises recesses co-operating with the centering head 27 and the lug 28 for preventing rotation. The recess co-operating with the centering head 27 receives the top of the tubes 10 when the measuring head 22 is in position under the anvil 21. When it is in use, this measuring head 22 is connected to the moving part of the frame 1 by means of two pins 29, whereof each connects one side of the head 22 to one of the slides 13 of the aforesaid movable part. The centering of the measuring head 22 takes place by means of a guide and centering head 30, provided at its upper part and able to engage in a complementary housing opening out under the anvil 21. The measuring head 22 also comprises securing members (not shown) making it possible to grip either the top of the tubes 10, or the centering head 27 of the support 26. A flexible lead 31 connects the pick-ups of the measuring head 22 to the recording devices.

Figure 2:
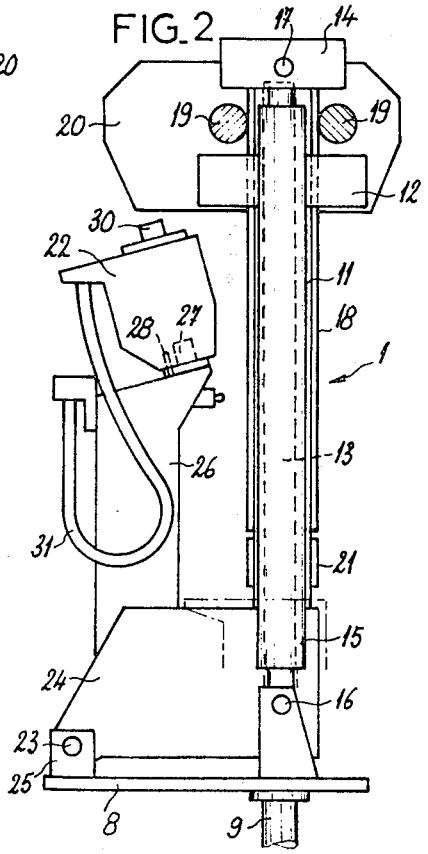
FIG. 2 is a side view showing only the frame, drawn to an enlarged scale, in the lower and untilted position.

When the apparatus is inoperative, it is in the position of FIG. 2. The fixed part of the frame 1 rests on the platform 8 such that the slides 11 are vertical and the movable part of the frame is lowered. The lorry thus has a limit height enabling it to pass under any obstacles.

Figure 4:
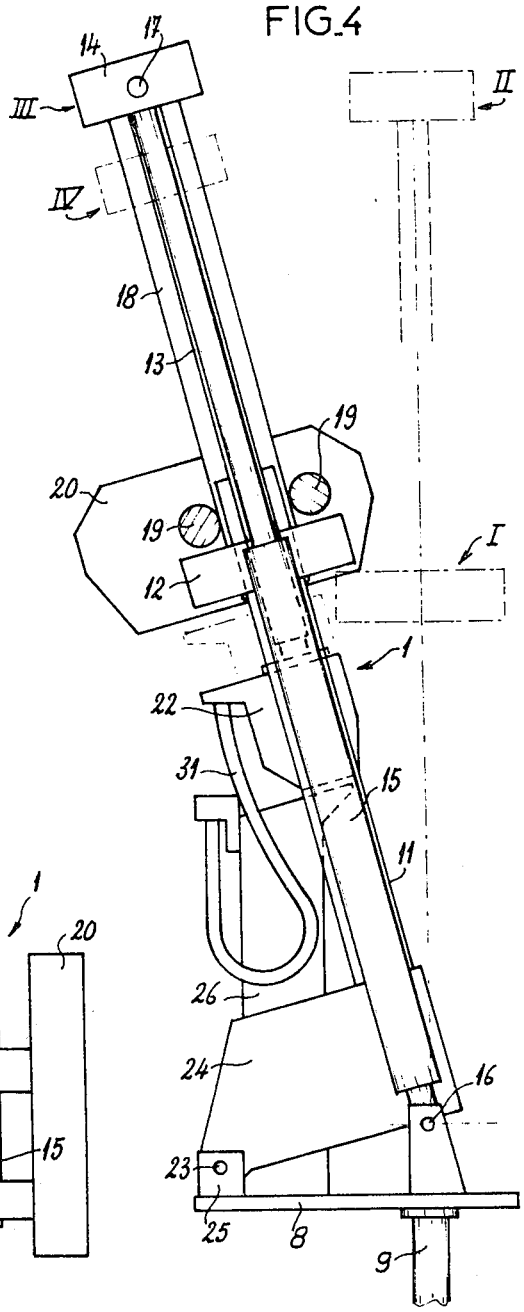
FIG. 4 is a side view showing this frame in the upper and tilted position.
Figure 5:
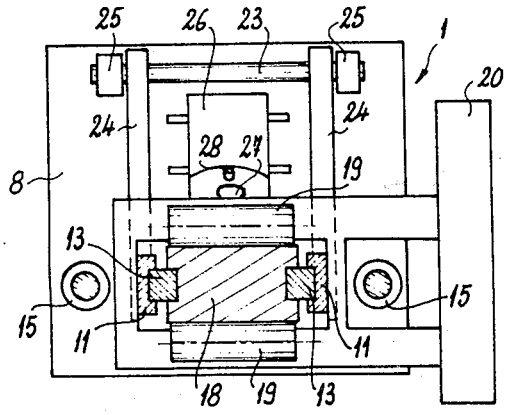
FIG. 5 is a plan view of this same frame partially in section.

If, starting from this inoperative position, it is desired to carry out measurements, it is necessary to retrieve the measuring head 22 and position it under the anvil 21. The operation may be carried out quickly and automatically in the following manner, illustrated in FIG. 4:

The rams 15 are actuated in order to raise the moving bar 14 vertically from its lower position I to the upper position II, in which the slides 13 reach the end of their travel. During this movement, the slides 13 entrain the hammer 18 and anvil 21. In fact, the latter rests on four stops 32 provided with dampers and located on the slides 13 at an intermediate level between the anvil 21 and the bores facilitating the passage of the pins 29 serving to connect the measuring head 22.

From position II, the rams 15, which are not yet at the end of their travel, continue to push the moving bar 14. The frame 1 cannot be extended any further and it begins to pivot about the horizontal pivot 23. This tilting movement continues until the moving bar 14 has reached its position III, in which its distance with respect to the pin 16 for pivoting the rams 15 is maximum. In this position, the plane of the slides 11 and 13 passes through the head 27 for centering the measuring head 22.

Since the frame 1 is retained in the tilted position by means which are not shown, the rams 15 are actuated in order to lower the moving bar 14 and consequently, the entire moving part of the frame with the slides 13, the hammer 18 and the anvil 21. The downwards movement continues until the moving bar 14 reaches position IV, a position in which the head 30 for guiding and centering the measuring head 22 engages in the complementary housing of the anvil 21.

The measuring head 22 is then connected to the fixed part of the frame and separated from its support 26 and reverse movements are carried out for returning the frame 1, with the measuring head 22, to its normal position of use, i.e. its vertical position.

When the head 22 is in position, it is possible to carry out the measurements of static driving or extraction. For example, if it is desired to carry out drilling by dynamic driving, it is necessary to return the measuring head 22 to the storage position on the support 26. To this end, the rams 15 are actuated as previously, in order to tilt the frame 1, then the moving part of this frame is lowered until the measuring head 22 is positioned on its support 26, which it encounters during its descending movement.

Furthermore, the frame 1 is tilted into position III each time it is necessary to add or remove a basic member of the set of tubes 10. The frame is thus retracted sufficiently to correctly expose the space located above the guide 9 for the tubes 10.

Furthermore, and in manner known per se, the rams 15 are used in normal operation for static driving andd extraction of the tubes.

It should be noted that the frame 1 illustrated in the drawing, also comprises a device 33, a so-called "copying device" located on one of its sides at the rear of the slide 11, making it possible to record the driving-in of the tubes 10 by means of movements of the anvil 21. This copying device is not part of the invention and is optional.

Naturally, the invention is not limited to the single embodiment of this tilting penetrometer frame, which was above-described as a non-limiting example: on the contrary, it includes all variations.

What is claimed is:

1. A penetrometer structure comprising:

a platform support;

a pair of upright first slides pivotally mounted on said support for tilting movement about a horizontal axis, said first slides having a vertical first position wherein they lie in a vertical plane spaced from said pivot and a tilted second position wherein said first slides are inclined to said vertical plane;

a movable member comprising a pair of movable slides shiftable along said first slides;

a cross-piece connecting said movable slides;

a pair of hydraulic rams pivotally connected to said support and to said member for tilting said first slides and elevating said member along said first slides;

a hammer mounted on said member and guided on said movable slides for movement therealong; and guide means in said plane for guiding a set of tubes to be driven by said hammer downwardly from said support.

2. A penetrometer structure comprising:

a support platform;

a first frame mounted on said support platform, said first frame comprising a pair of transversely spaced upright first slides, a crossbar interconnecting said first slides at upper portions thereof, and respective arms extending from said first slides at the bottoms thereof;

a guide on said platform adapted to receive a succession of tubes for guiding same downwardly;

means pivotally connecting the free ends of said arms to said platform at a horizontal pivot axis horizontally spaced from said guide and enabling tilting movement of said first frame from a position wherein said first slides and said first crossbar lie in a common vertical plane of said guide into a second position wherein said first slides and first crossbar are inclined to said plane;

a movable second frame guided on the first slides of said first frame, said second frame having a pair of second slides movable along said first slides, a second crossbar interconnecting said second slides, and driving hammer received between said second slides and guided thereon for vertical movement relative to said second slides; and a pair of hydraulic rams pivotally connected to said platform substantially in said plane for tilting movement about a second horizontal axis and pivotally connected to said second frame for elevating same along said first frame and for tilting both said frames about the first-mentioned horizontal axis.

3. The penetrometer defined in claim 2, further comprising a pair of adhesion rollers mounted on said second frame and engageable with said hammer to displace same away from said platform.

4. A penetrometer structure comprising:

a support platform;

a first frame mounted on said support platform, said first frame comprising a pair of transversely spaced upright first slides, a crossbar interconnecting said first slides at upper portions thereof, and respective arms extending from said first slides at the bottom thereof;

a guide on said platform adapted to receive a succession of tubes for guiding same downwardly;

means pivotally connecting the free ends of said arms to said platform at a horizontal pivot axis horizontally spaced from said guide and enabling tilting movement of said first frame from a position wherein said frist slides and said first crossbar lie in a common vertical plane of said guide into a second position wherein said first slides and first crossbar are inclined to said plane;

a movable second frame guided on the first slides of said first frame, said second frame having a pair of second slides movable along said first slides, a second crossbar interconnecting said second slides, and a driving hammer received between said second slides and guided thereon for vertical movement relative to said second slides;

a pair of hydraulic rams pivotally connected to said platform substantially in said plane for tilting movement about a second horizontal axis and pivotally connected to said second frame for elevating same along said first frame and for tilting both said frames about the first-mentioned horizontal axis;

a support mounted on said platform and offset from said plane but straddled by said second slides in the inclined position of said first frame; and a measuring head receivable on said platform and adapted to be carried by said second frame between said hammer and a tube disposed in said guide, said support being positioned so as to be located on the trajectory of said head when, with the frames in their inclined position, said second frame is lowered by said rams.

5. The penetrometer defined in claim 4, further comprising a centering head on said support for receiving said measuring head and a lug on said support engageable with said measuring head for preventing rotation thereof on the support.

6. The penetrometer defined in claim 4 wherein said second frame is provided with an anvil having a centering recess, said measuring head having a centering formation receivable in said recess and a pair of outwardly extending parts engaging said second slides, respective pins securing each of said parts to the respective second slide.

7. The penetrometer defined in claim 6 wherein each of said second slides comprises at leas one damping device disposed above the respective pin and below said anvil.

* * * * *